United States Patent [19]

Sugawara

[11] Patent Number: 4,552,355

[45] Date of Patent: Nov. 12, 1985

[54] PENETRATION-THROUGH-WALL MAGIC SET

[75] Inventor: Shigeru Sugawara, Tokyo, Japan

[73] Assignee: Tenyo Company, Ltd., Tokyo, Japan

[21] Appl. No.: 617,020

[22] Filed: Jun. 4, 1984

[51] Int. Cl.[4] ..... A63J 5/00

[52] U.S. Cl. ..... 272/8 R

[58] Field of Search ..... 272/8 R, 8 N, 8 D, 9, 272/27 R, 27 N; 273/153 R

[56] References Cited

U.S. PATENT DOCUMENTS 4,339,120 7/1982 Czarny ..... 272/8 R

OTHER PUBLICATIONS

B. C. Vapor Block, Louis Tannen, Inc., No. 13, Catalog of Magic 1980, p. 399, New York, New York.

Double Visible Block Go. Louis Tannen, Inc., No. 13, Catalog of Magic 1980, p. 414.

Block-O. Louis Tannen, Inc., No. 13, Catalog of Magic 1980, p. 419.

Cabala, Louis Tannen, Inc., No. 13, Catalog of Magic 1980, p. 465.

Bud West's "Blarney-Die" Abbott's Magic Co., Colon, Michigan 49040, Catalog No. 22, p. 169.

*Primary Examiner*—Robert A. Hafer

*Assistant Examiner*—Arnold W. Kramer

*Attorney, Agent, or Firm*—Murray, Whisenhunt & Ferguson

[57] ABSTRACT

A penetration-through-wall magic set comprising a hollow tube opened at the opposite ends thereof and having formed therein a pair of slots opposite to each other with the tube bore between them, a gimmicked panel including a solid piece as wide as the length of the slots in the tube and having an opening smaller than the tube bore, and a solid pliable piece stuck at one end thereof to the solid piece and overlapping the latter, and an object capable of passing through the opening in the solid piece of the gimmicked panel. The solid pliable piece is extended at the free end thereof over the end of the solid piece so that when the solid piece and solid pliable piece are inserted across the tube from one to another of the slots therein, said over-extending end of the solid pliable piece abuts the inner wall of the tube around the slot so as to be freed from the solid piece.

5 Claims, 13 Drawing Figures

PENETRATION-THROUGH-WALL MAGIC SET

BACKGROUND OF THE INVENTION

The present invention relates to a household magic set, and more particularly to a set for magic where an object penetrates through a wall.

Various kinds of magic gimmicks and sets have been proposed and widely used to provide amusements usable in commercial fields and homes as well. The magic set according to the present invention can be one of such amusements.

SUMMARY OF THE INVENTION

The present invention seeks to provide a set for such a magic that even when a hollow tube opened at opposite ends thereof is completely blocked by a panel across the tube, an object can penetrate through the tube from one opening to another thereof passing through the panel.

The magic set according to the present invention comprises a hollow tube opened at opposite ends thereof and provided with a pair of slots opposite to each other with the tube bore between them, a gimmicked panel including a solid piece as nearly wide as the length of the slots in the tube and which has an opening smaller than the bore of the tube, and a solid pliable piece stuck at one end thereof to the solid piece and overlapping the latter, and an object capable of passing through the opening in the solid piece of the gimmicked panel, said solid pliable piece of the gimmicked panel having the free end thereof extended beyond the end of the solid piece.

When the gimmicked panel is inserted through the tube from one slot to another therein, the solid pliable piece passes along with the solid piece through the first slot, but the over-extending end thereof will come into contact with the inner wall surface of the tube around the other slot. Thus the over-extending or free end of the solid pliable piece is blocked from passing through the second slot and it is bent inside the tube so as to be separated from the solid piece. When the tube is shown at the solid pliable piece side to the spectators, they cannot recognize the existence of the opening formed in the solid piece since the opening is hidden by the solid pliable piece. However, when inserted into the tube from the solid piece side, the object can pass through the opening in the solid piece, force the solid pliable piece to bend and thus pass through the tube to the other end thereof.

The tube should preferably be formed to have a number n of walls (n=4 or a larger even number in the present invention) and each of the slots has a length closely related to the distance between opposite inner walls to which the direction of inserting the gimmicked panel is perpendicular, for thereby permitting to completely block the tube bore by the gimmicked panel and with a minimum wall thickness of the tube so that the spectators can be persuaded that the tube has no gimmick, and minimize the spectators' attention to the gimmicked panel. The tube should preferably be formed to have a square shape, for thereby permitting to provide a rectangular gimmicked panel due to which the spectators will have little doubt about any trick in the magic set.

The inner surfaces of the tube as well as the outer surfaces of the solid piece and solid pliable piece of the gimmicked panel are painted in a same color, and should preferably be painted in black, or more preferably in mat black, for thereby providing a difficulty with which the spectators find the existence of the trick provided in the gimmicked panel.

The object should preferably be formed so as to smoothly penetrate through the tube without being stuck in the tube itself and gimmicked panel whichever opening of the tube the object is inserted from; therefore, the object must be formed without any protrusion. Thus the object should preferably have the form of a ball.

These and other objects and advantages of the present invention will be better understood from the ensuing description made by way of example of the embodiment of a penetration-through-wall magic set according to the present invention with reference to the drawings.

DETAILED DESCRIPTION OF THE PREFERRED EMBODIMENTS

Figure 1:
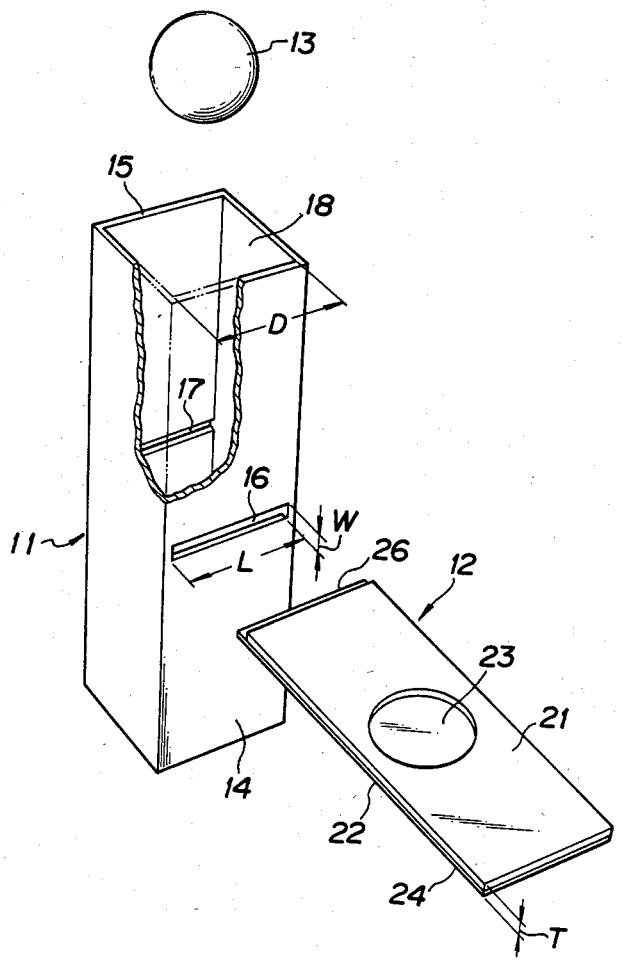
FIG. 1 is an exploded, perspective view of one embodiment of the inventive penetration-through-wall magic set, with the tube, one of the components, shown partially cut away.

Referring now to FIG. 1, the magic set according to the present invention comprises a tube 11, gimmicked panel 12 and an passing-through object 13 like a ball.

The tube 11 is hollow and open at the opposite ends thereof. It has a square section, for example. This tube 11 has formed in the opposite walls 14 and 15 thereof in the lateral direction a pair of opposite slots 16 and 17, respectively, each of which has a length L equal to the length D of the inner wall 18 of tube 11 and a width W rather larger than the thickness T of the gimmicked panel 12.

The gimmicked panel 12 consists of a solid piece 21 which is not easily pliable, and a solid pliable piece 22. The solid piece 21 has an opening 23 formed in the center thereof. The solid pliable piece 22 is stuck at one end 24 thereof to the solid piece 21 and the other or free end is freely pliable. This solid pliable piece 22 is as wide as the solid piece 21, but is somewhat longer than the latter, the free end thereof being extended by a small overextending portion 26 over the end of the solid piece 21. The total thickness of the gimmicked panel 12, that is the sum T of the solid piece thickness and pliable piece thickness, is sufficiently smaller than the width of the slots 16 and 17 so that when the gimmicked panel is inserted into the tube 11 from one of the slots, the gimmicked panel 12 is slightly rotatable about the contact point between the slot and itself. The entire surface of the gimmicked panel, namely, the outer surfaces of the solid piece 21, opening 23 therein and the solid pliable piece 22 are all painted in black.

Figure 2:
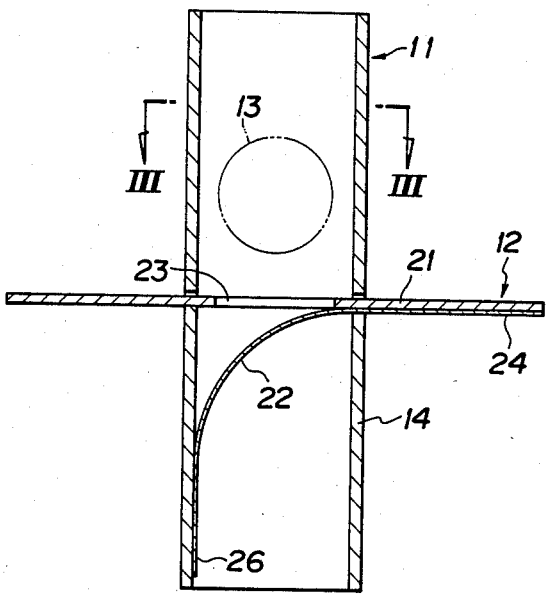
FIG. 2 is a sectional view showing the gimmicked panel inserted across the tube.
Figure 3:
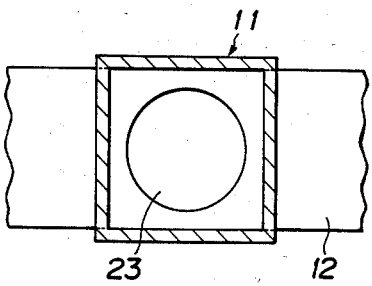
FIG. 3 is a cross sectional view taken along the line III—III of FIG. 2.
Figure 4:
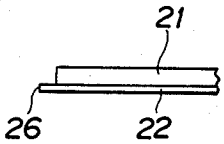
FIG. 4 is a side elevation showing the free end of the gimmicked panel in enlarged scale.
Figure 7:
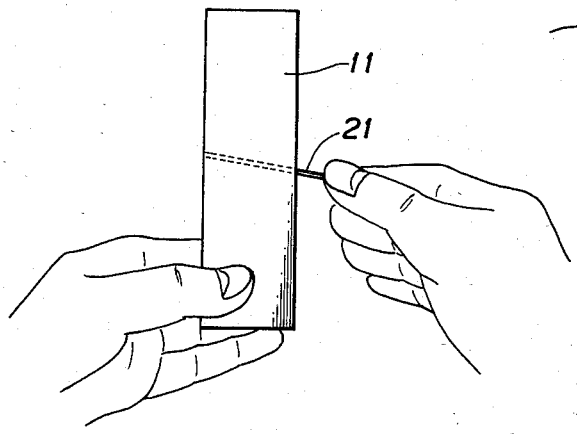
Figure 8:
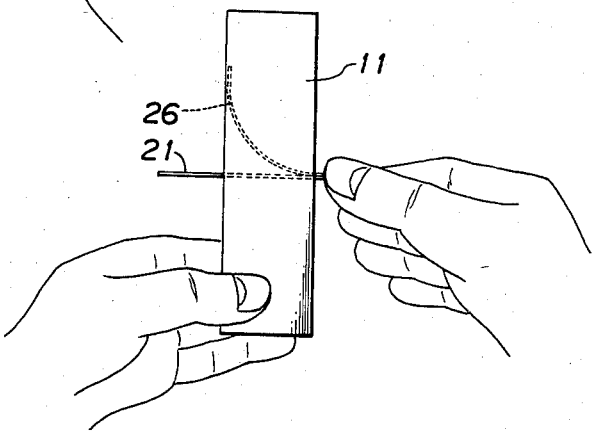

The gimmicked panel 12 is inserted through the tube 11 from one of the slots 16 or 17 therein. The gimmicked panel 12 is inserted as a little inclined into the slot 16 and abuts at the other end to the inner wall above the slot 17 as shown in FIG. 7. At this time, the over-extending portion 26 of the solid pliable piece 22 first abuts the inner wall 18 of the tube 11. As the gimmicked panel 12 is rotated downward about the contact point between the slot 16 and gimmicked panel 12 as shown in FIG. 8, the solid pliable piece 22 is bent. When the front end of the solid piece 21 coincides with the slot 17, the gimmicked panel 12 is pushed into the slot 17 so that the solid pliable piece 22 is further bent, which is shown in FIG. 2.

The object 13 is made of, for example, a steel ball and has a diameter smaller than that of the opening 23 formed in the solid piece 21 of the gimmicked panel 12. After dropping from one end of the tube 11 through which the gimmicked panel 12 is inserted, more particularly from the opening near the solid piece 21, the ball 13 will pass through the opening 23 in the solid piece 21 and then fall onto the solid pliable piece 22. Since the pliable sheet 22 is not inserted at the end thereof into the slot 17, the ball will cause the solid pliable piece 22 to bend and drop out from the other opening of the tube 11. After the ball 13 passes through, the solid pliable piece 22 will be returned at the free end 26 thereof due to its own elasticity to the bent state and get into contact again with the tube inner wall 18 of the tube 11 in which the slot 17 is formed, for thereby concealing the opening in the solid piece 21 from the sight through the opening of the tube 11 near the solid pliable piece 22.

Figure 5:
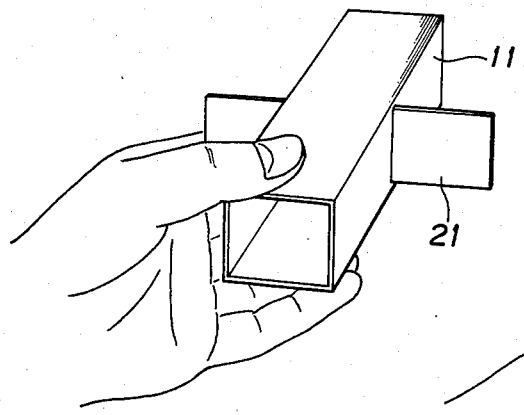
FIGS. 5 through 13 are explanatory drawings showing an example of magic performance using the inventive magic set, of which the steps will be given in sequence.
Figure 6:
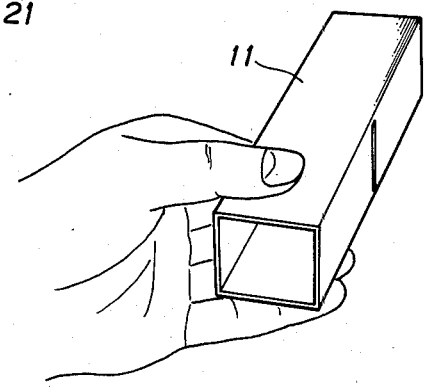
Figure 9:
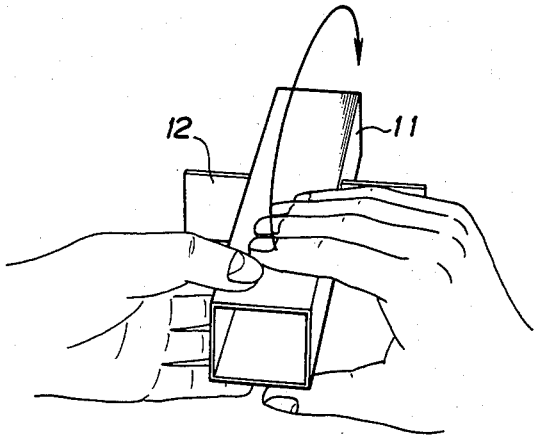
Figure 10:
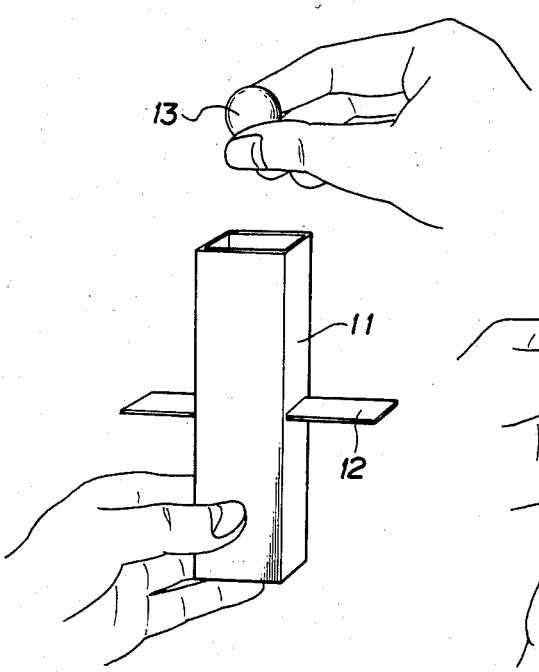
Figure 11:
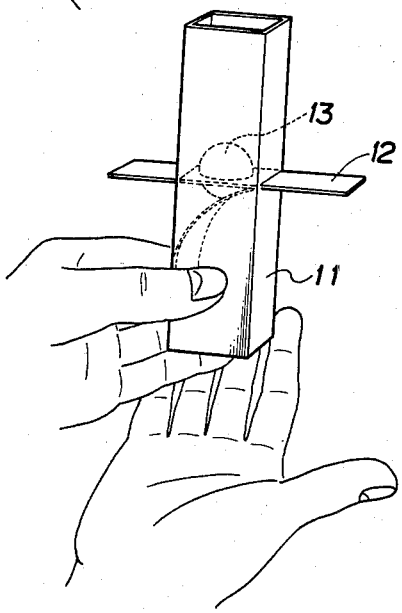
Figure 12:
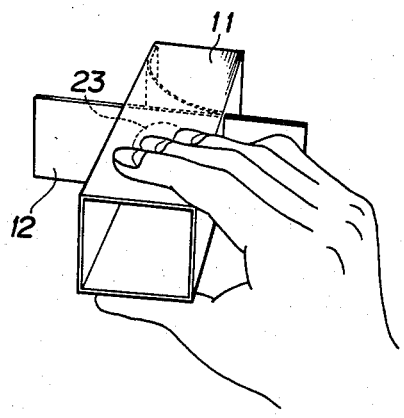
Figure 13:
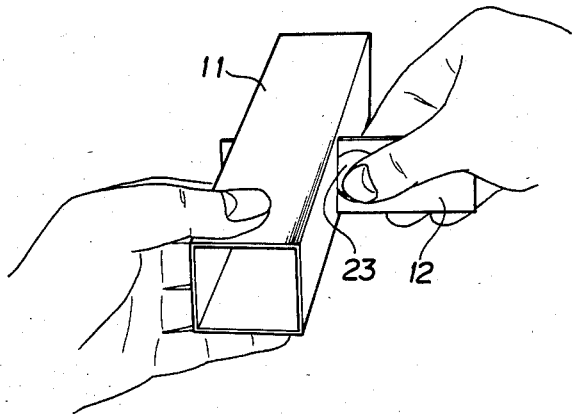

The inventive magic set can be effectively used in magic performance as follows:

The tube 11 with the gimmicked panel 12 inserted therethrough is placed on a table, with the stuck portion between the solid piece 21 and solid pliable piece 22 to the right. At this time, the gimmicked panel 12 is passed with the solid piece 21 and solid pliable piece 22 together through both the slots 16 and 17 in the cylinder 11. The ball 13 should be kept in a position, such as pocket, from which it can readily be taken out. The tube 11 is lifted up along with the gimmicked panel 12 by the magician in the left hand, and directed at the openings toward the spectators so that they can well see inside as shown in FIG. 5. Then the gimmicked panel 12 is pulled out of the tube 11 by the right hand, and the gimmicked panel 12 is put on the table with the solid pliable piece 22 upside. The tube 11 without the gimmicked panel 12 is directed at the openings toward the spectators, as shown in FIG. 6, to show them that the tube 11 is empty. Thereafter, the tube 11 is held vertically, and the gimmicked panel 12 is inserted into the tube 11 in such a manner as will appear the same as in the above to the spectators; at this time, the insertion should be done in practice as in the following. The gimmicked panel 12 is held at the stuck portion 24 between the solid piece 21 and solid pliable piece 22 by the right hand, and inserted into the righthand slot 17 in the tube 11. When the gimmicked panel 12 is completedly inserted at the left end thereof, namely, at the non-stuck end, in the tube 11, the end is raised a little as shown in FIG. 7 so as to incline the gimmicked panel 12. With the left end of the gimmicked panel 12 kept abuting the tube inner wall above the other slot 16, the gimmicked panel 12 is returned to horizontal position by pushing the gimmicked panel 12 slightly leftward. The solid pliable piece 22 of the gimmicked panel 12 is bent upward of the cylinder 11, as shown in FIG. 8, and the solid pliable piece 22 is returned to the horizontal position due to its elasticity. As the gimmicked panel 12 is pushed as it is, the end of the solid piece 21 will come out of the tube slot 16. This will appear to the spectators as if the gimmicked panel 12 is inserted across the tube 11 without any trick. The gimmicked panel 12 is inserted until the tube 11 comes to the middle of the gimmicked panel 12. Then, the tube 11 is directed at the top opening thereof toward the spectators so that they can see inside. At this time, they see the bent solid pliable piece in the tube 11, but as the tube inside is so dark that they will take it as if only a single panel had been inserted across the tube 11. As shown in FIG. 9, the tube 11 is held at the lower portion thereof by the right hand and turned to vertical position with the bottom side up. Then, the tube 11 is held at the lower portion thereof by the left hand, and the ball 13 is taken out by the right hand. The ball 13 is dropped into the tube 11, and it will pass through the tube. It will come out of the bottom of the cylinder, which is shown in FIGS. 10 and 11. This performance is repeated once again to emphasize that the ball has passed through the blocked tube 11. Then, the tube is directed at the bottom opening thereof toward the audience so that they can see inside; they will see as if the tube bore 18 were blocked by the gimmicked panel 12. Keeping the tube 11 directed at the opening thereof toward the spectators, the tube 11 is held by the left hand this time, and the gimmicked panel 12 is pulled out by the right hand. When the left end of the solid panel 12 is still inside the tube 11, the right hand is released from the gimmicked panel 12 once, and as shown in FIG. 13, it is pulled out by grasping the gimmicked panel 12 near the center thereof. Due to this secret move, it is possible to prevent the free end of the solid pliable piece 22 from opening slightly when the gimmicked panel 12 is completely pulled out. The gimmicked panel 12 is placed on the table with the solid pliable piece 22 upside and the tube interior 11 is directed at the openings thereof toward the spectators so that they can well see inside. That is all for the magic performance.

What is claimed is:

1. A-penetration-through-wall magic set, comprising:

a hollow tube open at opposite ends thereof and having a tube bore;

a pair of slots in said tube opposite to each other with their common plane perpendicular to said tube;

a gimmicked panel including a solid piece as wide as the length of said slots in said tube, said solid piece having an opening smaller than said tube bore, and a solid pliable piece as wide as said solid piece stuck at one end thereof to one end of said solid piece and overlapping said solid piece;

an object capable of passing through said opening in said solid piece of said gimmicked panel;

said solid pliable piece at its free end extending beyond the free end of said solid piece so that when solid piece and said solid pliable piece are inserted across said tube through one slot towards the other slot at a slight angle, said free end of said solid pliable piece abuts the inner wall of said tube adjacent said other slot so as to be separated from said solid piece, said solid piece then being aligned with said other slot so that on extension of said solid piece through and beyond both slots, said free end of said solid pliable piece travels along the inner wall of said tube bore so that said object on being dropped into said tube and through said opening in said solid piece pushes said solid pliable piece aside and falls completely through said tube bore.

2. A penetration-through-wall magic set as claimed in claim 1, in which said tube has a number n of sides, wherein n is 4 or a greater even number, and said slots have a length closely related to the distance between opposite inner walls of said tube in a direction perpendicular to the direction of inserting said gimmicked panel into said slots.

3. A penetration-through-wall magic set as claimed in claim 1, in which the inner walls of said tube, and the outer surfaces of said solid piece and said solid pliable piece of said gimmicked panel are painted in the same color.

4. A penetration-through-wall magic set as claimed in claim 3, in which said color is black.

5. A penetration-through-wall magic set as claimed in claim 3, in which said object is a ball.

* * * * *